US009458705B2

(12) United States Patent
Semple et al.

(10) Patent No.: US 9,458,705 B2
(45) Date of Patent: Oct. 4, 2016

(54) MULTIPLE USE TERMINATION SYSTEM

(71) Applicant: Baker Hughes Incorporated, Houston, TX (US)

(72) Inventors: Ryan P. Semple, Owasso, OK (US); Jeffrey G. Frey, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 52 days.

(21) Appl. No.: 14/273,169

(22) Filed: May 8, 2014

(65) Prior Publication Data

US 2014/0335712 A1 Nov. 13, 2014

Related U.S. Application Data

(60) Provisional application No. 61/822,169, filed on May 10, 2013.

(51) Int. Cl.
*H01R 13/52* (2006.01)
*E21B 43/12* (2006.01)

(52) U.S. Cl.
CPC ..... *E21B 43/128* (2013.01); *H01R 13/5205* (2013.01); *Y10T 29/49117* (2015.01)

(58) Field of Classification Search
CPC ..... H01R 13/52; H01R 13/59
USPC ..... 439/935, 271
See application file for complete search history.

(56) References Cited

U.S. PATENT DOCUMENTS 4,003,620 A * 1/1977 O'Brien ..... H01R 13/523 174/22 R
4,868,967 A * 9/1989 Holt ..... F16L 5/02 174/135
5,458,507 A * 10/1995 Colescott ..... H01R 13/5205 439/589
5,700,161 A 12/1997 Plummer
5,920,032 A * 7/1999 Aeschbacher ..... E21B 17/206 138/113
7,355,122 B2 4/2008 Moore
7,455,541 B2 * 11/2008 Jackson ..... H01R 13/5205 439/274
7,473,129 B2 * 1/2009 Jackson ..... H01R 13/5205 439/589
8,708,727 B2 * 4/2014 Spahi ..... H01R 13/523 174/152 GM
2006/0204359 A1 * 9/2006 Semple ..... F04D 1/063 415/170.1
2014/0370735 A1 * 12/2014 Nicholson ..... H01R 13/523 439/271
2015/0052989 A1 * 2/2015 Semple ..... E21B 47/0007 73/152.51
2015/0184670 A1 * 7/2015 Hill ..... E21B 43/128 417/414

FOREIGN PATENT DOCUMENTS

WO WO-2005/083846 9/2005

* cited by examiner

*Primary Examiner* — Abdullah Riyami
*Assistant Examiner* — Nader Alhawamdeh
(74) *Attorney, Agent, or Firm* — Law Offices of Mark L. Berrier

(57) ABSTRACT

Systems and methods for electrically connecting conductors of a downhole electric system using connector bodies that includes an outer housing, one or more inner conductors and an inorganic insulating material such as a glass-ceramic material which forms a fluid-tight seal between the outer housing and the inner conductor. The insulating material may be bonded to the outer housing and to the inner conductor. The insulating material may alternatively have an interference fit with the outer housing and the inner conductor. The connector bodies may have standardized connector interfaces to facilitate connection to complementary standardized connector interfaces on cable-end connectors, etc. Connector bodies may be formed as motor heads, mandrels for cable splices, penetrators, etc.

18 Claims, 8 Drawing Sheets

MULTIPLE USE TERMINATION SYSTEM

CROSS-REFERENCE TO RELATED APPLICATIONS

This application claims the benefit of co-owned U.S. Provisional Patent Application 61/822,169, filed May 10, 2013 by Semple, et al., which is incorporated by reference as if set forth herein in its entirety.

BACKGROUND

1. Field of the Invention

The invention relates generally to power subsystems for downhole equipment such as electrical submersible pumps (ESP's), and more particularly to means for making robust connections between power system components the downhole equipment.

2. Related Art

Downhole equipment such as ESP systems are commonly installed in wells for purposes of producing fluids (e.g., oil) from the wells. Power suitable to drive the equipment is produced at the surface of the wells and is delivered to the equipment via power cables that extend into the wells. The power cables may have one or more electrical junctions, such as splices to motor leads and "pothead" connectors that couple the power cable to the downhole equipment.

It is very common in conventionally designed electrical junctions that fluids (e.g., oil and well fluids) will be introduced into the junctions. For example, in a conventional pothead connection between a power cable and an ESP motor, a pothead connector is connected to terminal conductors that extends through an insulation block (an "i-block") in the motor head. The i-block is designed to allow oil from the motor to flow between the i-block and the motor head, thereby filling any open spaces within the junction of the pothead connector and the motor terminals. As the motor is operated, small debris particles in the oil may accumulate at the pothead junction, eventually causing short-circuits between different conductors within the junction and corresponding power failures. The same fluid paths that allow oil to flow out of the motor and into the pothead connection may also allow well fluids to leak into the motor, contaminating the oil in the motor and degrading its performance.

There are other types of problems with conventional electrical junctions as well. For example, cable splices are typically made using tape splicing materials, or in some cases mandrel-type splices. In the case of a tape splice, the metal armor and electrical insulation are peeled back from the conductors of to cable ends and, after the conductors are spliced, the junction is wrapped with electrically insulating tape to provide electrical insulation, and then polytetrafluoroethylene (PTFE) tape to provide some hoop strength. The metal armor is then replaced. The problem with this type of splice is that the electrical splicing tape and PTFE tape are organic, elastomeric materials that are subject to wear and subsequent failure in the well environment. In the case of mandrel-type splices, mechanical connectors are coupled to a mandrel to make the splice, but rubber boots, electrical tape or other, similar organic/elastomeric materials were typically used at the coupling of the connectors to the cable, so these materials are subject to wear in the same manner as tape splices.

It would be desirable to provide improved means for making electrical connections between downhole equipment such as ESP motors and their respective power supplies, wherein the connections are more robust than conventional electrical connections and can withstand wear in the well environment, as well as high pressures, high temperatures, and high mechanical stresses.

SUMMARY OF THE INVENTION

The present system provides a means to make electrical connections while at the same time forming robust pressure seals around the conductors. One of the components of the system is a connector body that has an insulator which surrounds one or more conductors and insulates the conductors from an outer housing. The insulator may be a glass-ceramic or other inert inorganic material. The insulator forms a seal against both the conductors and the housing. The connector body may be configured to be coupled to a second component—a standardized cable-end connector—at one or both ends of the connector body. The connector body may be used in various different types of connections, such as motor connections (between the conductors internal to the motor and conductors of a power cable external to the motor), splices (between two cable segments), penetrators (which extend through sealing elements such as wellheads, packers or ESP can/pod hangers), and the like.

The present electrical connection system may be used, for example, to supply high-voltage electrical power to the motor of an ESP. This connection system is designed to provide a simple and extremely robust means to connect a power cable to the ESP. This technology can easily be adapted to provide the same type of functionality to low power applications such as tubing encapsulated conductor (TEC) wires used in downhole gauges or electrical control lines for other downhole tools. The use of a standardized connection configuration provides benefits such as allowing the use of standard components, reducing the amount of training required to work with the electrical connections, increasing consistency and reliability of the connections, and so on.

One embodiment comprises an electrical connector body which is adapted for use in a piece of downhole equipment, such as an ESP. The electrical connector body includes an outer housing, one or more inner conductors and an inorganic insulating material such as a glass-ceramic matrix which is positioned between the outer housing and the inner conductors. The insulating material electrically insulates the outer housing from the inner conductors, and also provides a seal that prevents fluids from passing through the connector body between the outer housing and the inner conductors. The insulating material may be bonded to the outer housing and the inner conductors, or it may have an interference fit in the space between these components. When the connector body is installed in a motor head, can or other equipment, a seal is provided around the exterior of the connector body (e.g., between a penetrator and a can) as well. These seals can withstand high pressure differentials and high temperatures that are encountered in a well environment.

In one embodiment, the electrical connector body may be integral to a motor head of an ESP motor. In this embodiment, the motor head forms the outer housing of the connector body. The inner conductors extend through the top of the motor head where a pothead would conventionally be positioned. The insulator is preferably bonded to both the motor head and the inner conductors. As an alternative to bonding the insulator to the motor head, the insulator can be bonded to a metal sleeve, which is then interference-fit, welded, brazed or otherwise secured within a cavity in the motor head. The interface between the insulator and the motor head, as well as the interface between the insulator and the inner conductors, is sealed, so that fluid cannot pass into or out of the motor through the motor head.

In another embodiment, the electrical connector body may be an elongated mandrel that has connector interfaces on both ends. The two connector interfaces are identical, standardized interfaces that are adapted to be coupled to the complementary interfaces of connectors that are provided at the ends of cables. These cables may, for example, include one or more TEC segments that are coupled together used to form all or part of the power cabling between a surface power supply and the downhole equipment. The TEC segments may be coupled together using mandrel-type splices as disclosed herein. The electrical pathway between the surface power supply and the downhole equipment may also include non-mandrel-type connectors, such as a motor head, penetrator and the like.

In some embodiments of the present invention, the insulating material in the connector body is bonded to the outer housing and to the inner conductors. The insulating material may be, for example, a glass-ceramic material (a matrix of both glass and ceramic. The insulating material may alternatively be glass alone, ceramic alone, or another inert, inorganic material. Some of these materials can be bonded directly to the metal of an outer housing and the inner conductors using existing technologies, thereby providing a fluid-tight pressure seal between these components of the connector body. As an alternative to bonding the insulating material to the outer housing and to the inner conductors, the insulating material can be interference fit between the outer housing and the inner conductors. In this case, the interference fit between the components provides the fluid-tight pressure seal between them.

Alternative embodiments may include methods for connecting components of a downhole electric equipment system using standardized multi-use electrical connectors. The use of the standardized connectors (each of which has one of two standardized connector interfaces) facilitates the connection of the system's components by eliminating, for instance, the need to individually strip cables, splice the conductors and rebuild the structure (e.g., electrical insulation and armor) around the conductors. The use of standardized connectors also standardizes and streamlines the training of field personnel who have to connect the system components.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
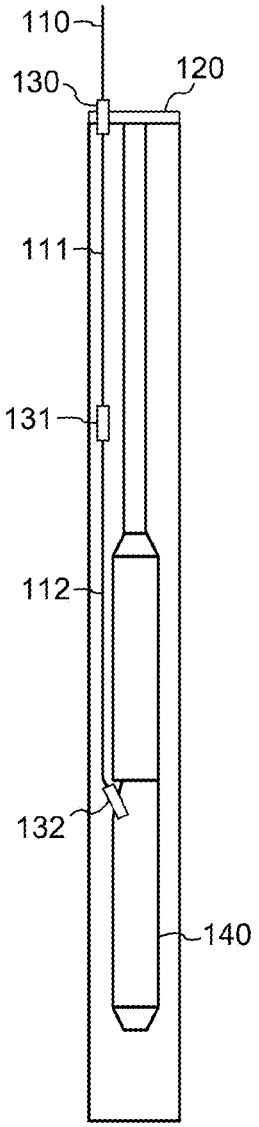
FIG. 1 is a diagram illustrating some of the electrical junctions in an ESP system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention. Further, the drawings may not be to scale, and may exaggerate one or more components in order to facilitate an understanding of the various features described herein.

DESCRIPTION OF EXEMPLARY EMBODIMENTS

One or more embodiments of the invention are described below. It should be noted that these and any other embodiments described below are exemplary and are intended to be illustrative of the invention rather than limiting.

The present system provides a means to make electrical connections while at the same time forming robust pressure seals around the conductors and providing very high temperature resistance. One of the components is a connector body that has an insulator made of a ceramic, glass or other inert inorganic material. The insulator surrounds one or more conductors and insulates the conductors from a mechanical housing. The insulator forms a seal against both the conductors and the housing. The connector body may be configured to accommodate a second component—a standardized cable-end connector—at one or both ends of the connector body. The connection may be implemented in various different types of connections, such as motor connections (between a set of motor lead extensions and an external power cable), splices (between two cable segments), penetrators (which extends through sealing elements such as wellheads, packers or can hangers), and the like.

The present electrical connection system may be used, for example, to supply high-voltage electrical power to the motor of an ESP. This connection system is designed to provide a simple and extremely robust means to connect the power cable to the ESP. This technology can easily be adapted to provide the same type of functionality to low power applications such as TEC wires used in downhole gauges or electrical control lines for other downhole tools. The use of a standardized connection configuration provides benefits such as allowing the use of standard components, reducing the amount of training required to work with the electrical connections, increasing consistency and reliability of the connections, and so on.

Referring to FIG. 1, a diagram illustrating some of the electrical junctions in an ESP system in accordance with one embodiment is shown. In this simplified diagram, an ESP is positioned within a can installed in a well. Power cable 110 is coupled to a power source at the surface of the well and extends to can hangar 120. Cable 110 is connected to a penetrator 130 that extends through can hangar 120 and allows electrical power to be conveyed through the hangar and into the can while maintaining a pressure seal between the interior and exterior of the can. In an alternative embodiment, a mandrel similar to penetrator 130 can be situated above or below can hanger 120, so that only the encapsulated conductors pass through the hanger. A cable segment 111 is coupled to the lower end of penetrator 130. Splice 130 couples the first cable segment 111 two a second cable segment 112. Second cable segment 112 is coupled through motor connector 132 to ESP motor 140. Motor connector 132 allows power to be conveyed from power cable segment 112 to the magnet windings within motor 140, while maintaining a seal between the interior and exterior of the motor.

Each of the electrical junctions in FIG. 1 (penetrator 130, splice 131 and motor connector 132) can implement embodiments of the present system. In each case, the junction is formed by a connector body (as described in more detail below) to which corresponding end-connectors are secured. In the case of penetrator 130 and splice 131, the end-connectors are attached to the ends of corresponding power cables (or cable segments). In the case of motor connector 132, one end-connector is coupled to a power cable segment (112), while the other end-connector is attached to the leads of the motor's stator lead wires. In one embodiment, each of the end-connectors has a standardized configuration which is identical to the others. This facilitates assembly, maintenance and repair of electrical junctions.

Figure 2:
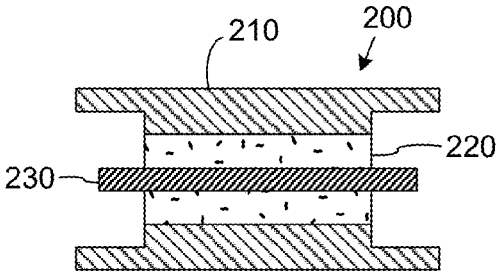
FIG. 2 is a simplified diagram illustrating the structure of a connector body in accordance with one embodiment.

Referring to FIG. 2, a simplified diagram illustrating the structure of a connector body in accordance with one embodiment is shown. In this embodiment, connector body 200 includes a housing 210, and insulator 220 and a conductor 230. Conductor 230 is a simple pin made of a conductive material such as copper. Conductor 230 is surrounded by insulator 220, which may be made of a ceramic or glass material, and is generally cylindrical in shape. Insulator 220 is positioned within housing 210. Insulator 220 forms a seal against both conductor 230 and housing 210. In one embodiment, insulator 220 is bonded to conductor 230 and housing 210 using ceramic-to-metal or glass-to-metal bonding technology. In alternative embodiments, the seal between insulator 220 conductor 230 and housing 210 may be created by forming the insulator within in the annulus between the conductor and the housing, or by configuring the components to provide an interference fit between the insulator and the conductor and between the insulator and the housing. This may be accomplished, for example, by heating an outer component (e.g., the outer housing) to expand it, placing the inner component (e.g., the insulator) in the outer component, and allowing the outer component to cool and shrink, thereby providing a tight fit between the components. The seal between insulator 220, conductor 230 and housing 210 provides a pressure barrier between the two ends of the connector body.

The pressure barrier provided by bonding the insulator to the conductor and the housing of the connector body serves to prevent leakage of oil and well fluids along the length of the conductor, as well as through the interface between the insulator and the housing. The materials and processes used in bonding this type of insulator to metal are proven technologies that are used in areas such a Subsea Electronic Modules (SEM) and have demonstrated pressure capabilities of up to 200,000 psi and temperature ratings of over 700 F. The use of this technology as described herein solves many problems with ESPs, downhole tools and their ancillary equipment.

Figure 3:
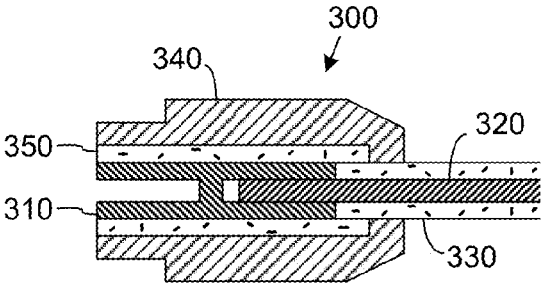
FIG. 3 is a simplified diagram illustrating the structure of a cable-end connector in accordance with one embodiment.

Referring to FIG. 3, a simplified diagram illustrating the structure of a cable-end connector in accordance with one embodiment is shown. In this embodiment, cable-end connector 300 includes a socket connector 310 which is configured to mate with conductor 230 of connector body 200. Socket connector 310 is connected to a conductor 320 of a power cable. Socket connector 310 is surrounded by insulating material 350, which fills an annular space within the housing of mechanical connector 340. Insulating material 350 and cable insulation 330 electrically isolate socket connector 310 and conductor 320 from the mechanical connector 340. The face of cable-end connector 300 is configured to mate with one end of connector body 200, and to secure the cable-end connector to connector body 200 and provide a high-pressure sealing element at this junction Because the connector body provides a pressure barrier, there is no need for the cable-end connectors to serve this function. The socket connector can therefore be made by such means as a semi-permanent (butt-splice/crimp or solder) or a removable (pin & socket/spring lamination) connection. These connection points are not subject to environmental pressure differentials, so they do not have to function as a pressure barrier, but only have to be insulated to prevent electrical tracking. The connection points would be insulated after the connection is made by such means as insulating tapes, heat shrink tubing, dielectric sleeves (PEEK) or even dielectric gels or greases.

It should be noted that, in recent years, there have been increasing numbers of harsh environment and critical service ESP applications in which three separate conductors (carrying phases A, B & C) are encapsulated in hard tubing such as stainless steel, Monel, Inconel or the like. (These may be referred to as encapsulated conductors.) The present connection system may be particularly useful in these encapsulated conductor applications, providing cable terminations that form robust pressure seals around the conductors while also providing effective electrical insulators to prevent tracking and electrical shorts.

The annular space that is formed between the insulation and the inner diameter of the tubing may be filled with an epoxy or other hard material. The hard tubing and insulation can be stripped back and for attachment of the cable-end connector. The hard tubing can be mechanically connected to the cable-end connector housing and secured, for example, with a metal sealing element of the type found in a Swagelok type of connector. The various elements of the mechanical connector could include replaceable inserts and seals that could be changed out in the field if they were damaged, without the need to replace the entire assembly.

The design of the present connection system addresses shortcomings associated with previous methods in such electrical junctions as motor connections, splices and penetrators. This can be done with a universal cable termination system that can be employed in various configurations to function in multiple uses. The system is sufficient to withstand more than the highest reservoir pressures and temperatures that are known today (30,000 psi & 550 F). The system is completely immune to long-term degradation as a result of its use of metal seals and inorganic (i.e non-elastomeric) materials. Additionally, the system can be quickly installed "in the field" without complicated tools or acquired skills (which vary from person to person, as is often the case with traditional methods). The system can use field-replaceable components, so that if something needs to be changed in the field, a standard set of components can be used to fix the issue. The same training, method and components apply to motor connectors, splices and penetrators.

Figure 4:
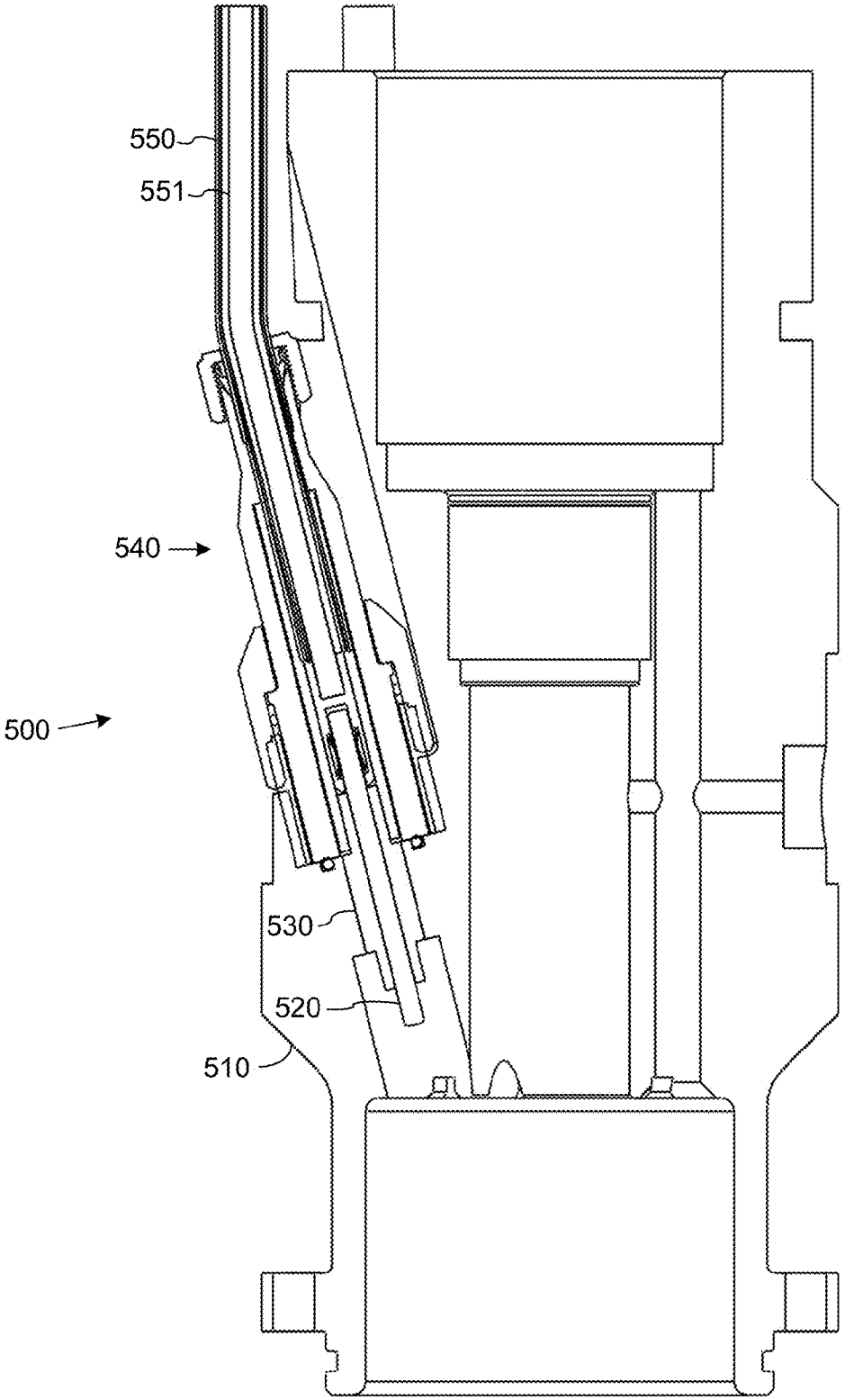
FIG. 4 is a cross-sectional view of a motor head for an ESP in accordance with one embodiment.
Figure 5:
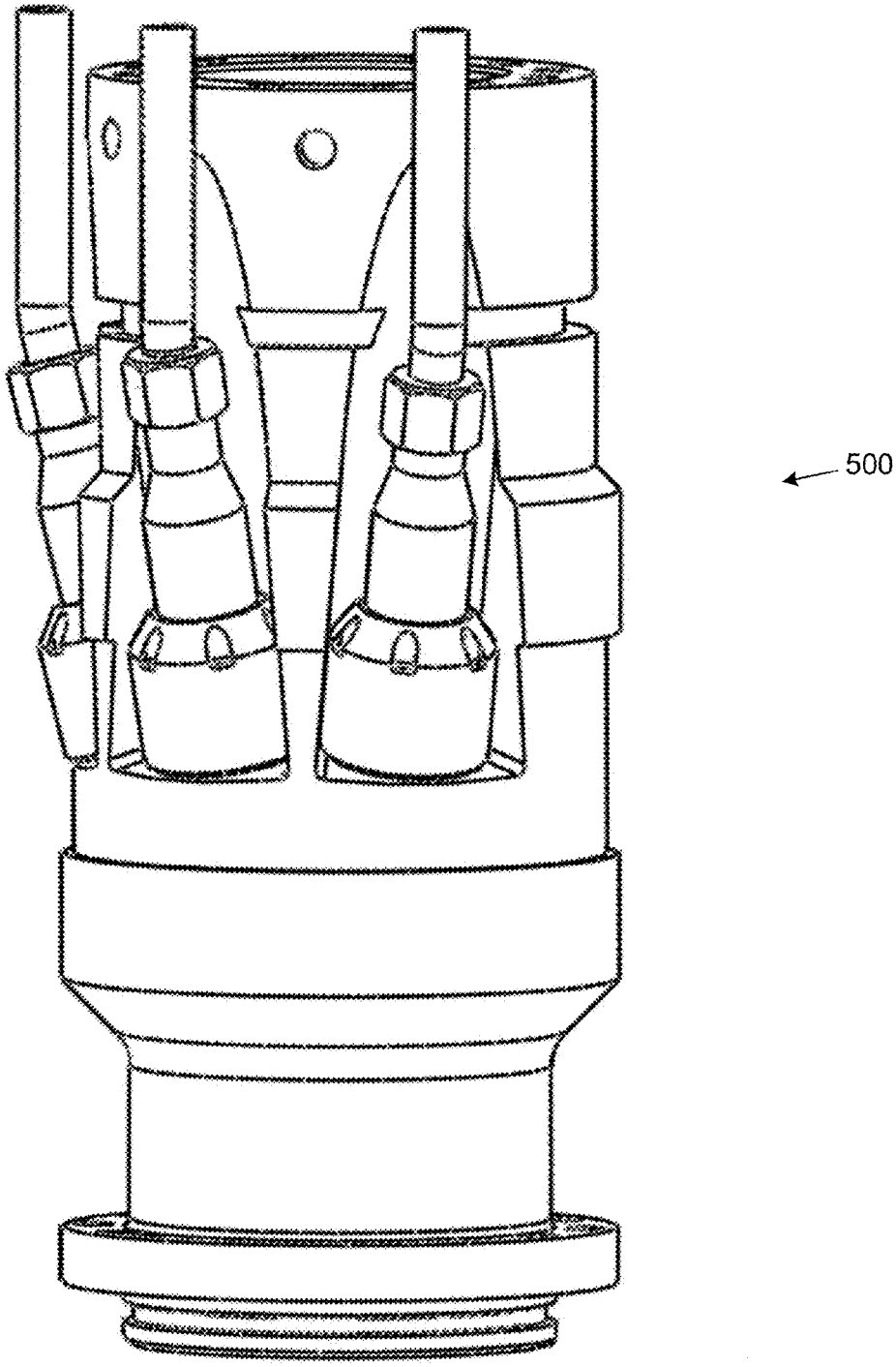
FIG. 5 is a perspective view of the motor head of FIG. 4.
Figure 6:
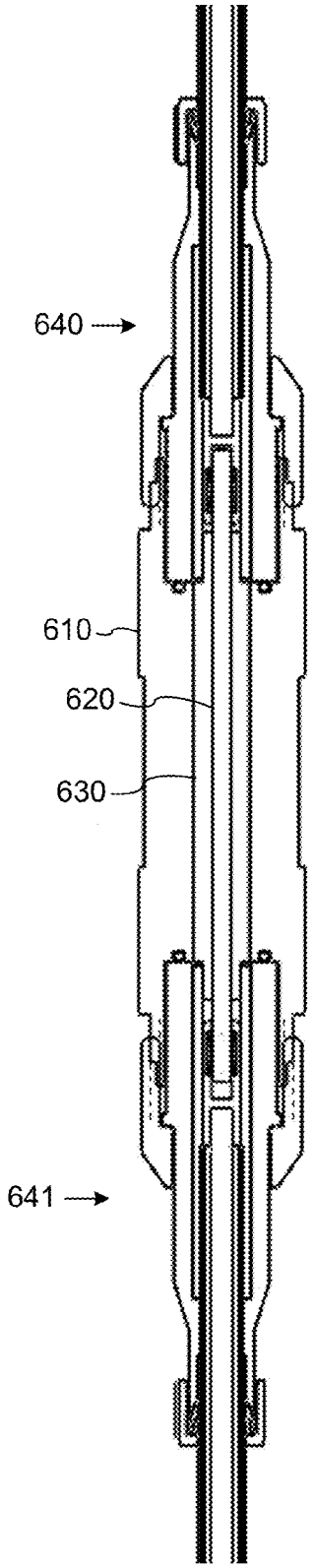
FIG. 6 is a cross-sectional view of a mandrel which forms a splice between encapsulated conductors an ESP power cable in accordance with one embodiment.
Figure 7:
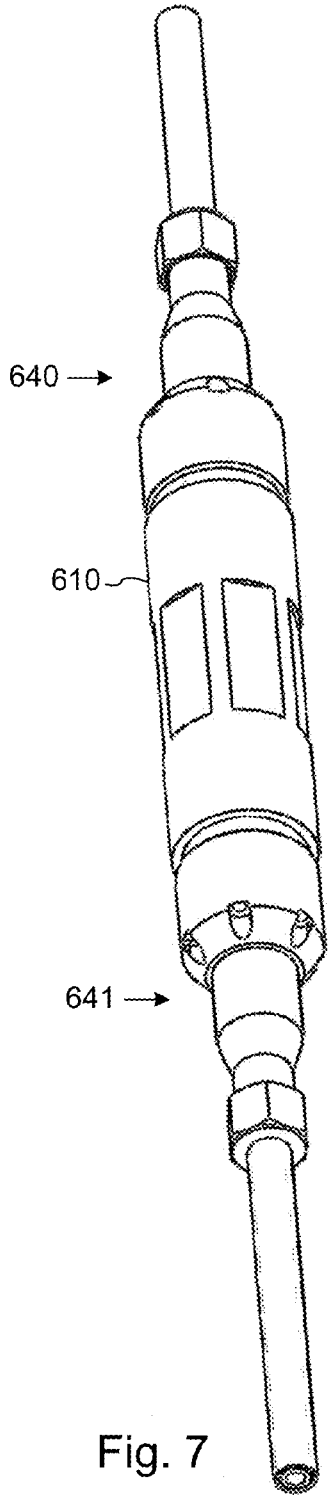
FIG. 7 is a perspective view of the splice of FIG. 6.
Figure 8:
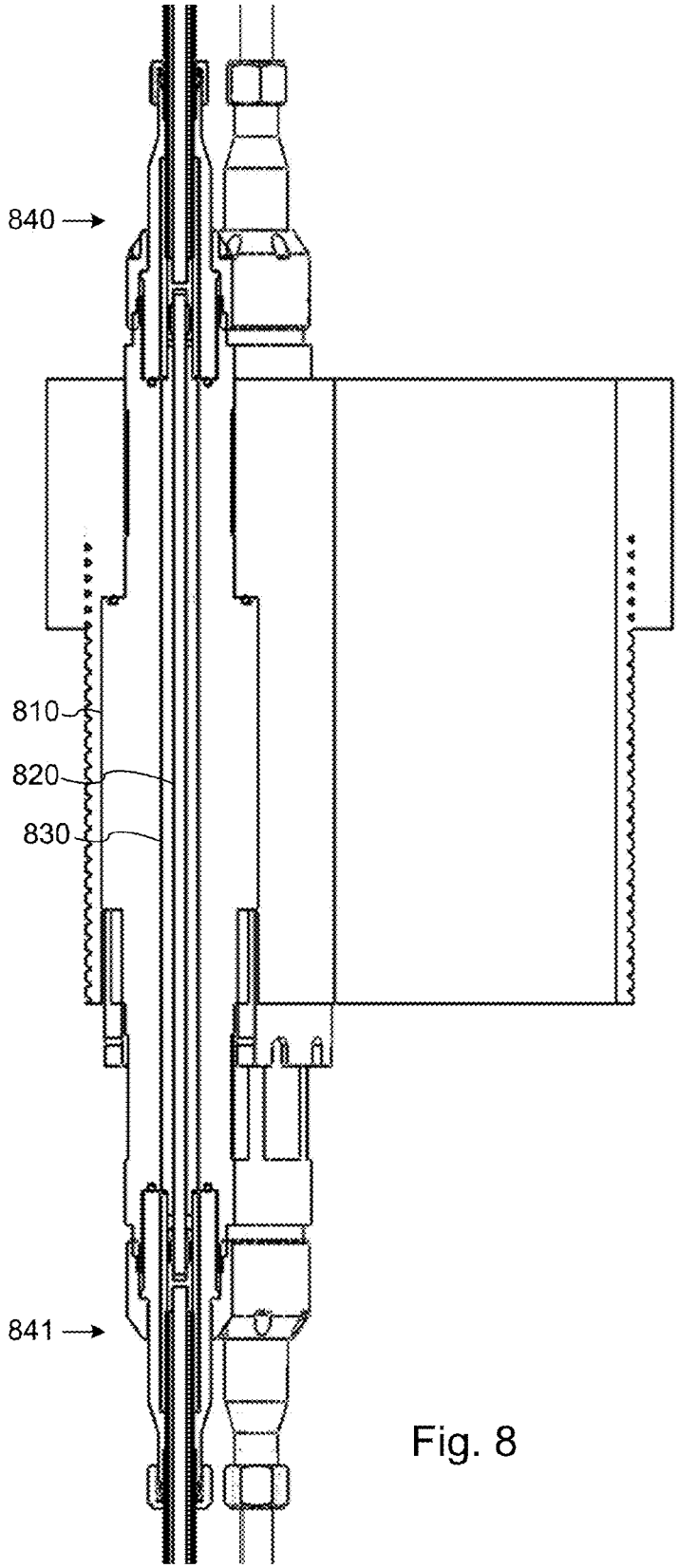
FIG. 8 is a cross-sectional view of a penetrator installed through a hanger in accordance with one embodiment.
Figure 9:
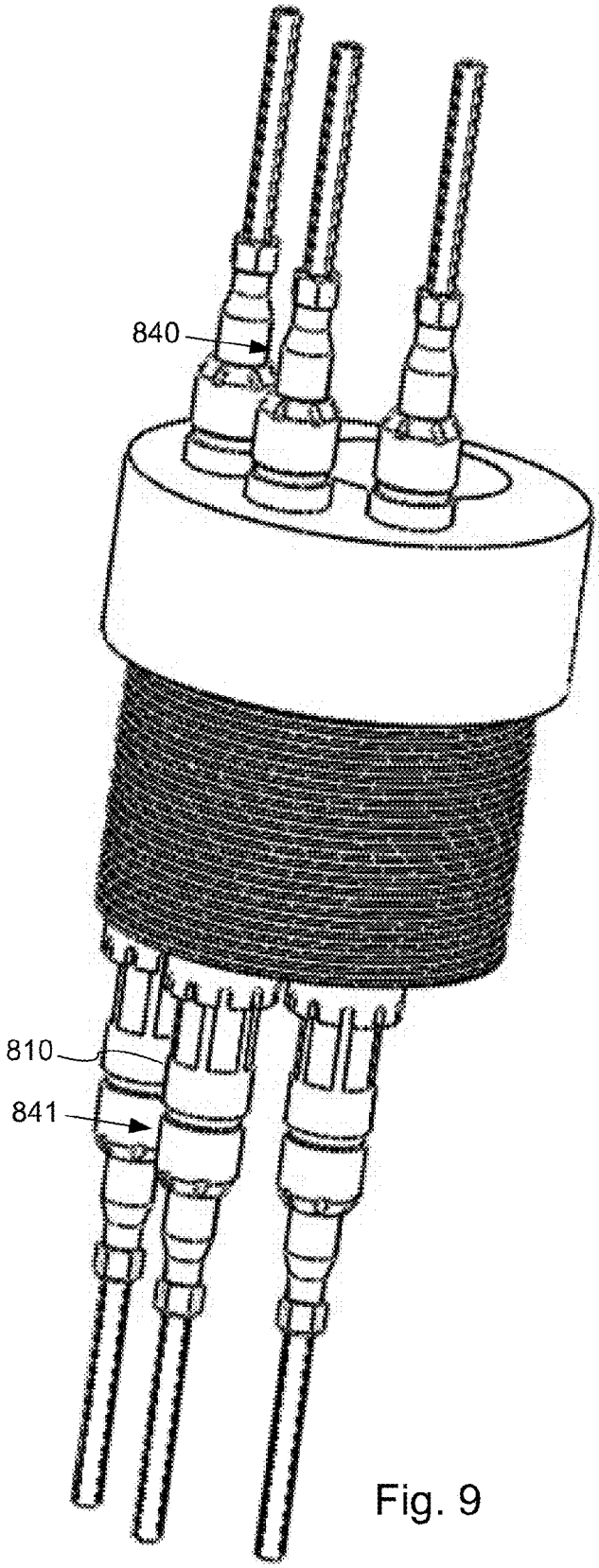
FIG. 9 is a perspective view of three penetrators installed in the hanger of FIG. 8.
Figure 10:
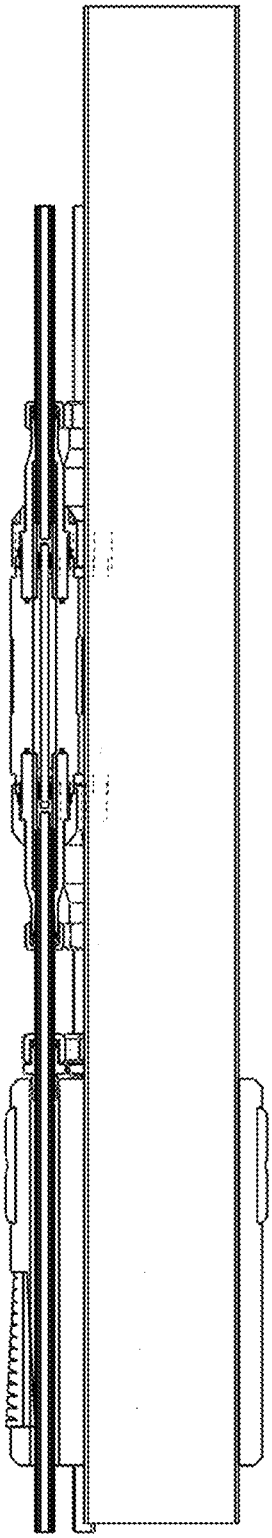
FIG. 10 is a cross-sectional view of a packer having encapsulated conductors that have sealed connections outside the packer.
Figure 11:
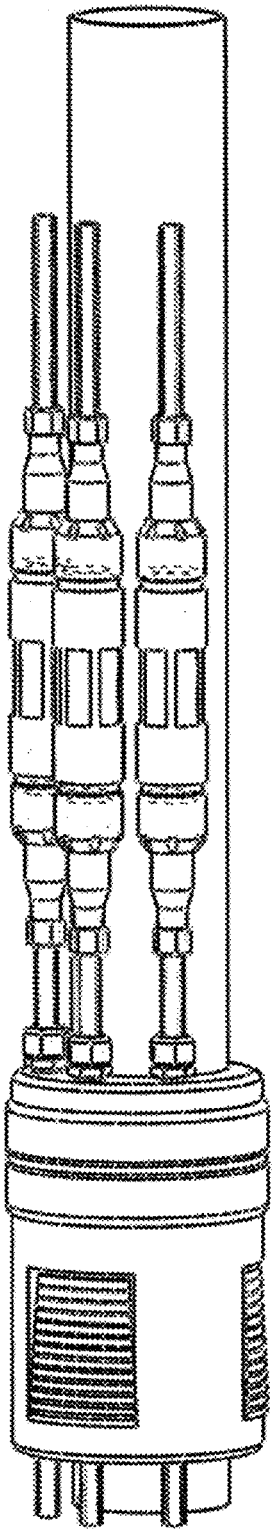
FIG. 11 is a perspective view of the packer of FIG. 10.
Figure 12:
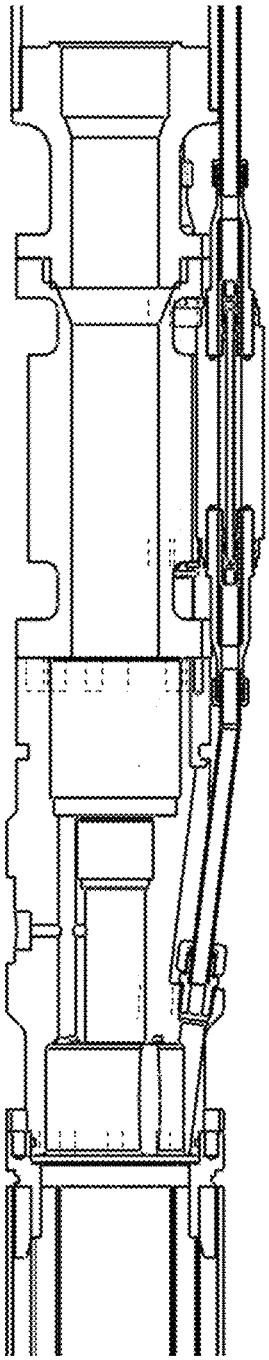
FIG. 12 is a cross-sectional view of an ESP motor having encapsulated conductors that have sealed connections outside the motor.
Figure 13:
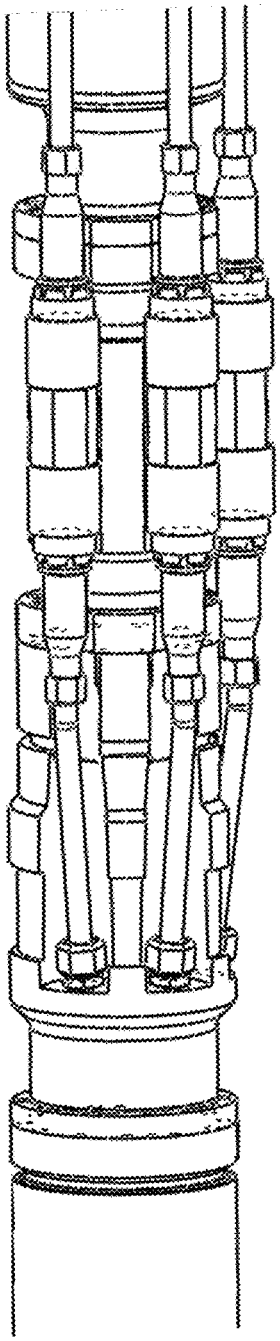
FIG. 13 is a perspective view of the ESP motor of FIG. 12.

Referring to FIGS. 4-13, several different embodiments of the present system are shown. Each of these embodiments utilizes an encapsulated conductor and a standardized ("universal") cable-end connector. FIGS. 4 and 5 show an embodiment which is implemented in the connection of a power cable to a motor. FIGS. 6 and 7 show an embodiment which is implemented in a splice between segments of a power cable. FIGS. 8 and 9 show an embodiment which is implemented in a penetrator that extends through a can hanger. FIGS. 10 and 11 show an embodiment which is implemented external to a packer. FIGS. 12 and 13 show an embodiment which is implemented external to an ESP motor. It should be noted that these embodiments are illustrative, and the system can be implemented in numerous other applications.

FIG. 4 is a cross-sectional view of a motor head for an ESP in one embodiment. FIG. 5 is a perspective view of the motor head. In this particular embodiment, the motor head 510 serves as the housing of the connector body. Separate connections are provided for each of three connector pins (e.g., 520) in the motor head. Individual insulators (e.g., 530) are bonded to the corresponding pins and to motor head 510. Alternatively, a single ceramic insulator could be bonded to all three connector pins and the motor head. In another alternative embodiment, the motor head could have removable units that could be inserted into the motor head, where each of the units is a separately constructed connector body. In the latter case, an inner conductor and insulator can be inserted into a metal sleeve and bonded together. This unit can then be inserted into a complementary cavity in the motor head and the outer housing can be welded or otherwise secured to the motor head. A metal sealing ring or gasket can be employed if desired to form an additional seal between the unit and the motor head. It should be noted that, because of the seal between insulator 530 and housing 510 and conductor 520 at the electrical junction (and between the connector body and the motor head in some embodiments), there is no path for oil to flow out of the motor, and no path through which well fluids can enter the motor.

In this embodiment, cable-end connector 540 is coupled to the motor head, thereby coupling the conductor 551 of motor lead extension 550 (an encapsulated conductor) to conductor 520, which extends into the motor head. Cable-end connector 540 is attached to the encapsulated conductor using Swagelok-type compression fittings against the hard tubing of the motor lead extension. A spin collar is utilized to secure cable-end connector 540 to the motor head. Metal seals between the cable-end connector and the motor head prevent well fluids from reaching conductor 520.

FIG. 6 is a cross-sectional view of a mandrel which forms a splice between encapsulated conductors an ESP power cable in accordance with one embodiment. FIG. 7 is a perspective view of the splice, including the mandrel, cable-end connectors and encapsulated conductors. In this embodiment, conductor 620 and annular ceramic insulator 630 are contained in a generally cylindrical housing (the mandrel body) 610. Insulator 630 is bonded to housing 610 and conductor 620. In this embodiment, a single conductor is implemented, but alternative embodiments could provide multiple conductors within (and bonded to) insulator 630. The ends of housing 610 are threaded and have features to allow a metal sealing ring or gasket to be installed between the mandrel and cable-end connectors 640 and 641. The cable-end connectors are attached to the encapsulated conductors using Swagelok-type compression fittings against the hard tubing of the encapsulated conductors. The mandrel and cable-end connectors could be used to attach multiple shorter lengths of encapsulated conductors together in the field, or to repair a damaged section.

A mandrel such as the one shown in FIGS. 6 and 7 could alternatively be used to splice an encapsulated conductor to an armored power cable. The structure of the mandrel would be the same as described above, providing a seal between the conductor, insulator and housing of the mandrel. The armored power cable could be stripped and prepared to make a normal butt-splice to a short length of encapsulated conductor. The cable could then be rebuilt at this splice, with the splice wrapped in tape and the reattached armor. The short length of encapsulated conductor could then be attached to a cable-end connector as described above. This cable-end connector could be secured to one end of the mandrel, while another section of encapsulated conductor is secured in the same manner to the other end of the mandrel.

FIG. 8 is a cross-sectional view of a penetrator installed through a hanger (e.g., a well head or can hanger) in accordance with one embodiment. FIG. 9 is a perspective view of three penetrators installed in the hanger. In this embodiment, each penetrator has a penetrator body (e.g., 810) with an annular insulator (e.g., 830) and conductor (e.g., 820) installed therein. In an alternative embodiment, all three conductors could be installed in (and bonded to) a single insulator within a single penetrator body. Insulator 830 is bonded to body 810 and conductor 820 to provide a pressure seal between the ends of the penetrator. The ends of the penetrator body are threaded so that cable-end connectors can be secured to it. A metal sealing ring or gasket is installed between the penetrator body and the cable-end connectors. Metal sealing rings or gaskets can also be installed between the penetrator body and the hanger to provide a pressure seal across the hanger.

FIG. 10 is a cross-sectional view of a packer that has encapsulated conductors passing through the packer and sealed connections outside the packer. FIG. 11 is a perspective view of the packer and electrical connections. In this embodiment, only the encapsulated conductors penetrate the packer. The encapsulated conductors are connected to mandrels (connector bodies) that are positioned outside the packer itself. This configuration minimizes the space that is required in the packer itself to provide electrical power through the packer, because the encapsulated conductors take up much less space than the bulkier mandrels. This configuration also has the advantage of keeping the electrical connections cooler because they can be situated in more benign, cooler completion fluids, rather than hotter and more malignant well production fluids. It should be noted that similar configurations can be implemented in other equipment, such as ESP can hangers or tubing hangers, placing the connection mandrels in relatively less hostile environments.

An embodiment of an ESP motor connection that uses a similar configuration is depicted in FIGS. 12 and 13. FIG. 12 is a cross-sectional view of a motor connection that has encapsulated conductors passing through the motor head, with sealed connections outside the motor. FIG. 13 is a perspective view of the motor. As in the packer of FIGS. 10 and 11, only the encapsulated conductors penetrate the motor head. The encapsulated conductors that pass through the motor head are connected to mandrels positioned outside the motor, again minimizing the space that is required in the motor to provide electrical power through the motor's housing. This may also be advantageous in that the electrical connections may be positioned in cooler, less hostile environments.

The cable-end connectors are attached to their respective encapsulated conductors in the same manner as described above. It should also be noted that the cable-end connectors used in the embodiments of FIGS. 4-13 all have the same configuration. As explained above, the use of identical connectors facilitates assembly, maintenance and repair of the components, requires less training and time than conventional electrical junctions, etc.

The various embodiments of the invention may include individual connector bodies, connections that include both a connector body and one or more cable-end connectors, and systems that include multiple connector bodies and corresponding cable-end connectors. Alternative embodiments may also include power cable systems, ESP systems and other downhole equipment systems that incorporate one or more of the connector bodies and/or cable-end connectors. In some embodiments, the connector bodies and corresponding cable-end connectors of these systems are identically configured, so that the cable-end connectors can be interchangeably coupled to the connector bodies.

The present systems may provide a number of advantages over conventional systems, including:

(a) multiple use—same or similar parts and interface can be used in motor connector, splices, and power penetrators;
(b) ultimate protection—allows for entire power system to be encapsulated in hard tubing from motor head through the well head; the elastomers of the insulation systems are completely isolated from harsh well environments; very applicable to mudline ESP applications;
(c) extreme pressure—both absolute and differential pressure capabilities are far beyond current ESP power connection technology
(d) extreme temperature—temperature ratings are far beyond what is currently known as ultra temperature;
(e) allows the internal pressure of motor and seal to operate at a higher differential pressure which could improve the performance of internal check valves or even potentially eliminate check valves;
(f) simple connection—very few parts and quick to install; saves time and is more reliable than traditional methods such as tape splices and other termination methods;
(g) pressure testable connection—ensures the sealing integrity before the system is run in hole;
(h) metal seals and inorganic materials: eliminates the long term degradation of elastomer seals due to temperature, chemicals, explosive decompression;
(i) field friendly—splices can be made anywhere on the cable string with simple tools; installation is quick and does not require advanced skills to perform splice; testable connections; reparable and interchangeable parts reduces risk and spare part inventory and training;
(j) positive internal pressure—positive pressure bias prevents fluid ingress;
(k) integrated alignment guides—eliminates mechanical stress imposed on the ceramic insulator;
(l) can be used on other power systems such as TEC and electric control line.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. An electrical connector body adapted for use in a piece of downhole equipment, the electrical connector body comprising: an outer housing; one or more inner conductors; an inorganic insulating material positioned between the outer housing and the inner conductors; wherein the insulating material electrically insulates the outer housing from the inner conductors; wherein the insulating material provides a fluid seal that prevents fluids from passing between the outer housing and the inner conductors; wherein the electrical connector body is installed in an electric submersible pump (ESP) motor, wherein the outer housing is installed in a motor head of the ESP motor, wherein the inner conductors extend from an interior of the ESP motor to an exterior of the ESP motor, wherein the fluid seal provided by the insulating material prevents oil in the interior of the ESP motor from passing through the electrical connector to the exterior of the ESP motor and prevents well fluids at the exterior of the ESP motor from passing through the electrical connector to the interior of the ESP motor.

2. The electrical connector body of claim 1, wherein the electrical connector body comprises an elongated mandrel, wherein the mandrel has a first end and a second end, wherein each of the first and second ends has an identical standardized first type of connector interface, wherein the type of connector interface is adapted to mate with and be secured to a complimentary second type of connector interface.

3. The electrical connector body of claim 1, wherein the insulating material is bonded to the outer housing and to the inner conductors.

4. The electrical connector body of claim 3, wherein the insulating material comprises a glass-ceramic matrix.

5. The electrical connector body of claim 3, wherein the insulating material comprises glass.

6. The electrical connector body of claim 3, wherein the insulating material comprises a ceramic.

7. The electrical connector body of claim 1, wherein each of the outer housing and the inner conductors is metal.

8. A downhole electric equipment system having multi-use electrical connectors, the system comprising:

a plurality of electrical cables, wherein each of the electrical cables includes one or more insulated electrical conductors therein;

a plurality of electrical connector bodies;

wherein each of the electrical connector bodies includes an outer housing, one or more inner conductors, and an inorganic insulating material positioned between the outer housing and the inner conductors, wherein the insulating material electrically insulates the outer housing from the inner conductors and provides a fluid seal that prevents fluids from passing between the outer housing and the inner conductors; and wherein each electrical connector body has at least one of a connector interface of a first type, wherein each electrical cable has at least one of a connector interface of a second type, wherein the connector interface of the first type is adapted to mate with the connector interface of the second type; wherein a first one of the plurality of electrical connector bodies is installed in a motor head of the ESP motor, wherein the inner conductors extend from an interior of the ESP motor to an exterior of the ESP motor, wherein the fluid seal provided by the insulating material prevents oil in the interior of the ESP motor from passing through the electrical connector to the exterior of the ESP motor and prevents well fluids at the exterior of the ESP motor from passing through the electrical connector to the interior of the ESP motor.

9. The downhole electric equipment system of claim 8, wherein the plurality of electrical connector bodies have a plurality of connector interfaces of the first type and wherein the plurality of connector interfaces of the first type are identical; and wherein the plurality of electrical cables have a plurality of connector interfaces of the second type and wherein the plurality of connector interfaces of the second type are identical; wherein each of the connector interfaces of the first type is adapted to mate with each of the connector interfaces of the second type.

10. The downhole electric equipment system of claim 8, wherein the motor head of the ESP motor comprises the outer housing of the first one of the plurality of electrical connector bodies.

11. The downhole electric equipment system of claim 8, wherein one or more of the plurality of electrical connector bodies comprises an elongated mandrel, wherein the mandrel has a first end and a second end, wherein each of the first and second ends has an identical connector interface of the first type.

12. The downhole electric equipment system of claim 8, wherein the insulating material is bonded to the outer housing and to the inner conductors.

13. The downhole electric equipment system of claim 12, wherein the insulating material comprises a glass-ceramic matrix.

14. The downhole electric equipment system of claim 12, wherein the insulating material comprises glass.

15. The downhole electric equipment system of claim 12, wherein the insulating material comprises a ceramic.

16. The downhole electric equipment system of claim 8, wherein each of the outer housing and the inner conductors is metal.

17. The downhole electric equipment system of claim 8, wherein one or more of the plurality of electrical cables comprises a tubing encapsulated conductor.

18. A method for connecting components of a downhole electric equipment system using multi-use electrical connectors, the method comprising:

providing one or more an electrical connector bodies, each of the electrical connector bodies including an outer housing, one or more inner conductors and an inorganic insulating material positioned between the outer housing and the inner conductors, wherein the insulating material electrically insulates the outer housing from the inner conductors and provides a fluid seal that prevents fluids from passing between the outer housing and the inner conductors, and wherein each electrical connector body has at least one of a connector interface of a first type, wherein all of the connector interfaces of the first type are identical;

providing one or more electrical cables, wherein each of the electrical cables includes one or more insulated electrical conductors therein, and wherein each of the electrical cables has at least one of a connector interface of a second type, which is adapted to mate with the connector interface of the first type, wherein all of the connector interfaces of the second type are identical; and for each of the one or more an electrical connector bodies, electrically coupling the inner conductors to the insulated electrical conductors of a corresponding one of the one or more electrical cables by mating the connector interface of the electrical connector body to the connector interface of the electrical cable, wherein the coupled inner conductors and insulated electrical conductors form a continuous electrical pathway.

* * * * *